United States Patent [19]

Broersma

[11] Patent Number: 4,625,341

[45] Date of Patent: Dec. 2, 1986

[54] REMOVABLY ATTACHABLE SHIELD FOR HELMET VISOR

[75] Inventor: Lester V. Broersma, Bellflower, Calif.

[73] Assignee: Bell Helmets Inc., Norwalk, Calif.

[21] Appl. No.: 755,931

[22] Filed: Jul. 18, 1985

[51] Int. Cl.[4] ..... A42B 1/08; A61F 9/06

[52] U.S. Cl. ..... 2/424; 2/9; 2/10

[58] Field of Search ..... 2/422, 424, 425, 6, 2/8, 9, 10, 12

[56] References Cited

U.S. PATENT DOCUMENTS

| | | | |
|---|---|---|---|
| 2,903,700 | 9/1959 | Finken et al. | 2/10 |
| 3,214,767 | 11/1965 | Weber | 2/9 |
| 3,727,235 | 4/1973 | Fisher | 2/10 |
| 3,774,239 | 11/1973 | Kotzar | 2/10 |
| 3,797,042 | 3/1974 | Gager, Jr. | 2/10 |
| 4,097,929 | 7/1978 | Lowe et al. | 2/424 X |
| 4,117,553 | 10/1978 | Bay | 2/10 |
| 4,210,972 | 7/1980 | Baclit | 2/10 |
| 4,475,254 | 10/1984 | Bay | 2/424 |

FOREIGN PATENT DOCUMENTS

| | | | |
|---|---|---|---|
| 2317580 | 10/1984 | Fed. Rep. of Germany | 2/10 |

*Primary Examiner*—Werner H. Schroeder
*Assistant Examiner*—J. L. Olds
*Attorney, Agent, or Firm*—William W. Haefliger

[57] ABSTRACT

A visor on a helmet incorporates a transparent curved shield that extends downwardly. The visor and shield have a tongue and groove interfit that provides a quick slide interconnection, without separate fasteners.

10 Claims, 12 Drawing Figures

REMOVABLY ATTACHABLE SHIELD FOR HELMET VISOR

BACKGROUND OF THE INVENTION

This invention relates generally to helmets, and more particularly to safety shields attachable to helmets of the type used, for example, by cyclists.

In the past, it was known to permanently attach transparent plastic shields to the sides of helmets, the shield extending forwardly and across the field of view of the wearer. This necessitated exterior pivot structure, at only two locations, and the shields could not easily be removed from the helmet; also, they would fracture at the pivot locations due to propagation of small cracks. It was also known to attach plastic shields to helmets and also visors as by means of exterior snaps; however, these could and did become detached, especially after extensive use, and at high cycle speeds with great wind force exertion on the shield. Further, no satisfactory way to attach shields to visors only, was known.

It is a major object of the invention to provide a shield and its attachment to a helmet, and especially a helmet pivoted visor, enabling removal of the shield, as well as tilting of the shield with the visor, and without externally exposed connections. Basically, the invention provides, in combination with a helmet;

(a) a transparent shield to be supported by the visor so as to extend downwardly from the visor in the helmet wearer's field of view, (b) the visor and shield having thereon tongue and groove inteconnection means that retain the shield to the visor along a curved path with said means extending along said path, (c) the interconnection means on the shield located at an upper edge defined by the shield.

As will appear, the shield typically has elongated bead structure to be receivable endwise in a groove in the visor; and the bead extends along the upper edge of the shield. Alternatively, the shield may have multiple tongues configured for rapid attachment to visor grooves. Further, the visor may have adjustable attachment to the helmet, whereby the visor and shield pivot together as the visor pivots; and the groove or grooves may be located proximate a forward periphery of the visor and opening downwardly. Provision for both types of grooves in one visor is also made.

It is an additional object to provide:

(a) a transparent shield to be supported by the visor so as to extend downwardly from the visor in the helmet wearer's field of view, (b) the shield having interconnection tongue means receivable into said groove means to retain the shield to the visor along said curved path, (c) the tongue means located at an upper edge defined by the shield.

Such means may comprise an elongated and curved bead, or multiple tongues, as referred to, and the shield may extend in a flat plane, when detached from the visor, for ease of molding.

These and other objects and advantages of the invention, as well as the details of an illustrative embodiment, will be more fully understood from the following specification and drawings in which:

DRAWING DESCRIPTION

Figure 11A:
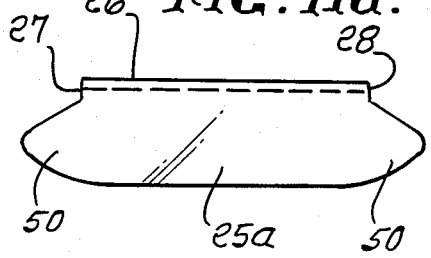
Figure 11B:
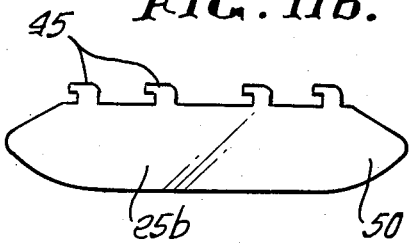

FIGS. 11*a* and 11*b* show shields in flat as molded shape.

DETAILED DESCRIPTION

Figure 1:
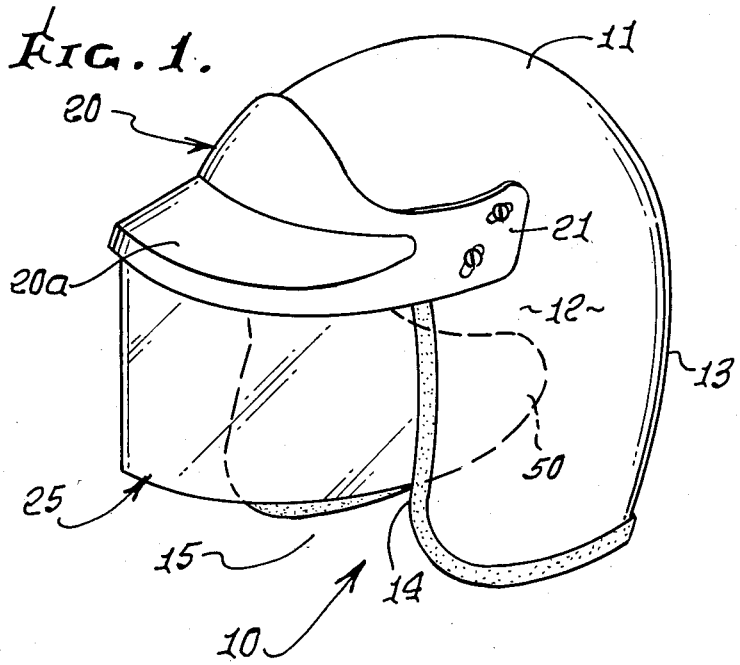
FIG. 1 is a perspective view showing a helmet with visor and shield, incorporating the invention.
Figure 2:
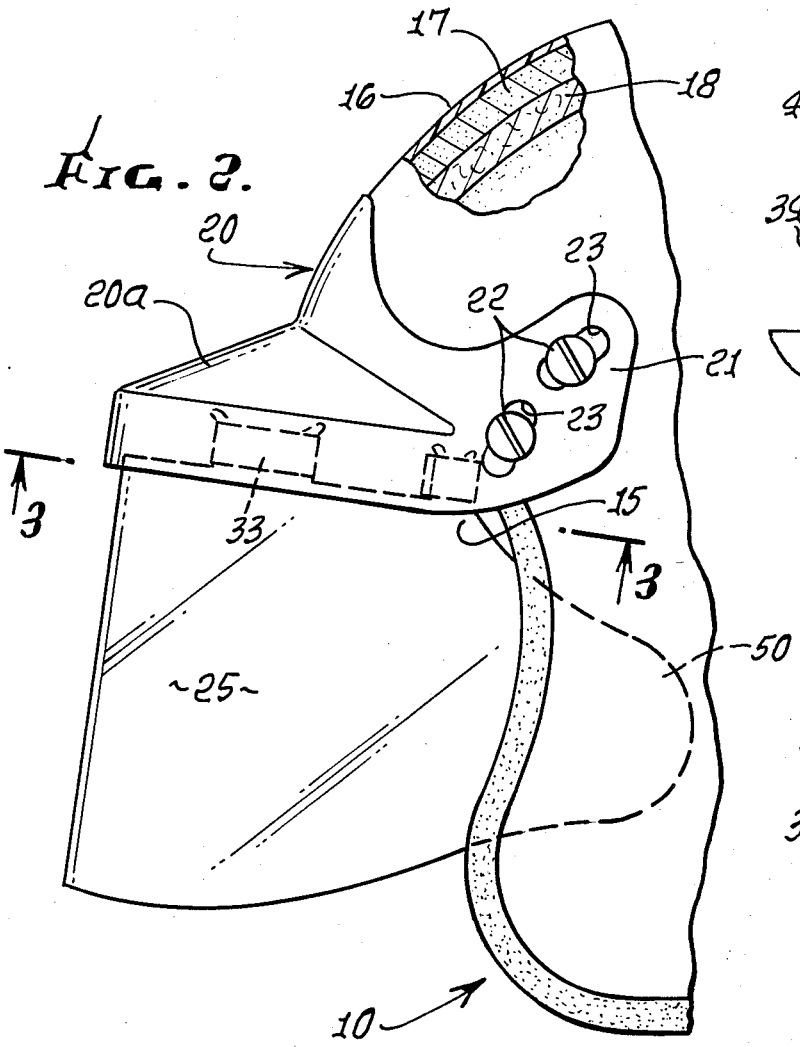
FIG. 2 is an enlarged fragmentary side elevation, showing the FIG. 1 helmet and visor.

In FIGS. 1 and 2 a cyclist's helmet 10 includes a top dome 11, side walls 12, rear wall 13, wall front edges 14 which project forwardly, and a front opening 15 via which the wearer may see forwardly. The helmet wall structure may include a hard, molded plastic outer shell 16, and a thicker liner 17 mode of rigid foam such as polyurethane. A pad such as indicated at 18 may be employed, and may include reticulated foam. If desired, the helmet may include inlet openings for air to enter the helmet and pass through the padding, and exit rearwardly, for ventillation.

A molded plastic, (or other material) visor 20 is attached to the helmet and juts forwardly at 20*a* above opening 15. The visor may be adjustably attached to the helmet, so as to be adjustably movable upwardly. To this end, the visor, as shown in FIG. 2, has elongated slots 23 in both visor wings 21 that fit the opposite exterior sides of the helmet, fasteners 22 fitting through side wings 21 and through the slots 23 so as to threadably fit to the helmet. Upon loosening of the fasteners, the visor may be tilted, due to the elongation of slots 23, allowing adjustable tilting of the removable shield 25, as will be described. The visor may be integral with the helmet, if desired.

In accordance with the invention, a transparent plastic shield 25 is adjustably firmly supported by the visor, and depends therefrom, as indicated in FIG. 1. The shield may be molded in flat, sheet-like condition, as seen in FIG. 11*a*, or 11*b*, and so as to be flexed to FIGS. 1 and 2 shape, when attached to the visor, thereby to wrap around the front opening 15, in forwardly spaced relation to the wearer's face.

Further, the visor and shield have an endwise elongated, curved, tongue and groove connection to enable feeding of the shield endwise progressively into the connection (and conversely quick progressive, endwise removal of the shield, to enable its replacement), the connection being at and associated with an upper edge portion of the shield. As will be seen, the connection is such as to be incapable of inadvertent removal, as by strong wind force exertion on the shield, or by inadvertent impact of the user's arm against the installed shield.

More specifically, usable shields are shown at 25, 25*a*, 25*b* and 25*c*. The shield 25*a* in FIGS. 11*a*, 8 and 9 has an integral linearly extending, or elongated, bead 26 extending lengthwise along its upper edge or rim, the bead having an L-shaped cross section, as shown. It may for example extend from left edge 27 to right edge 28 of the shield.

The visor has a corresponding bead receiving groove 29 sunk upwardly in its lower side near the forward periphery of the visor; the groove being forwardly convex. The groove is defined between vertical panels 30 and 31 depending from visor overhang 32 which slopes forwardly and downwardly. Third vertical panels 33 are located between and spaced from panels 30 and 31; and panels 33 are spaced apart lengthwise along the curved groove path, and connected by end walls 34 to panel 31, thereby to form other grooves 35.

Figure 8:
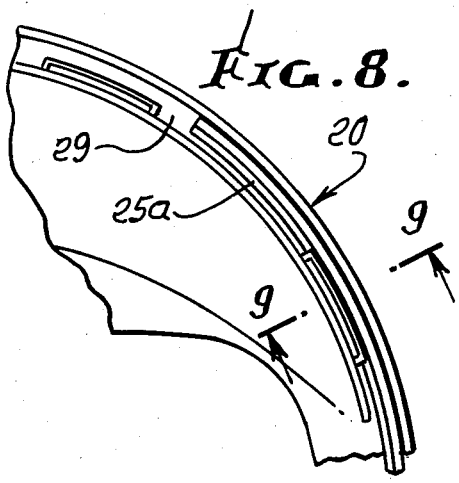
FIG. 8 is a fragmentary view like FIG. 3, showing shield continuous endwise feed into a visor.
Figure 9:
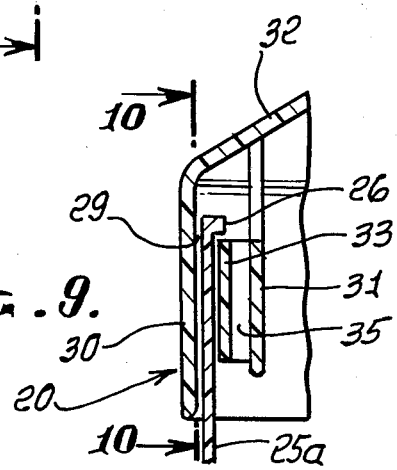
FIG. 9 is an enlarged section on lines 9—9 of FIG. 8; and of the shield and visor.

Groove 29 is adapted to receive endwise feeding of shield bead 26, as the shield is endwise progressively attached to the visor, as seen in FIGS. 8 and 9. The shield 25*a* loosely fits in the groove, and the bead overhangs the tops of panels 33 to support the shield in the groove. Feeding of the shield 25*a* into or out of the groove 29 proceeds progressively endwise, from either side of the visor.

Figure 4:
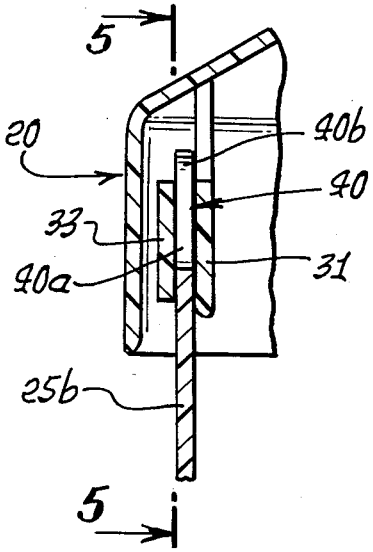
FIG. 4 is an enlarged section taken on lines 4—4 of FIG. 3.
Figure 5:
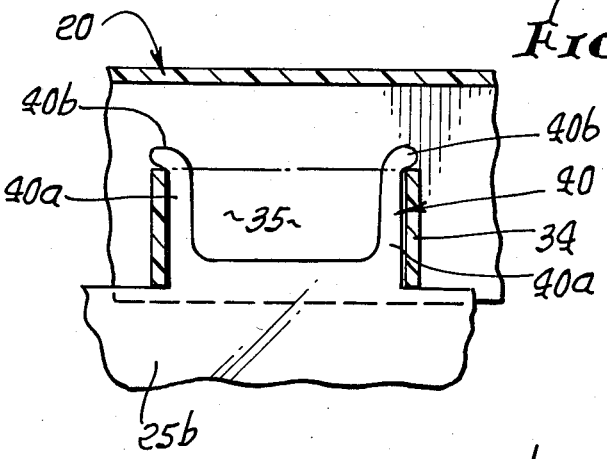
FIG. 5 is a front elevation on lines 5—5 of FIG. 4.

In the form of the invention seen in FIGS. 2, 4, and 5, the alternate shield tongue means comprises a series of tongues 40 spaced apart on the shield 25 along its upper edge length, the tongues projecting upwardly for quick reception into spaced grooves 35, and retention therein. Tongues 40 have J-shape, with upright portions 40*a*, and lateral portions 40*b* adapted to be flexed inwardly by walls 34 during tongue upward insertion into grooves 35. Upon completion of upward insertion, the overhang portions spring apart into position shown in FIG. 5, so that overhang portions 40*b* engage the tops of walls 34 and support the shield. Portions 40*b* are also angled to allow forcible pull-down removal of the shield.

Figure 7:
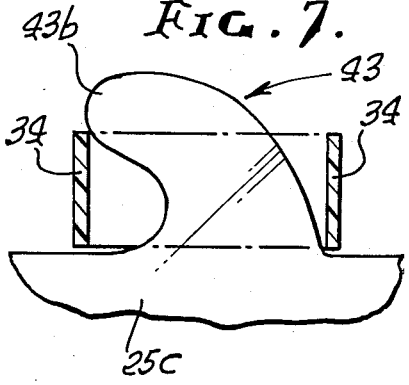
FIGS. 6 and 7 are views like FIG. 5, showing modification.
Figure 10:
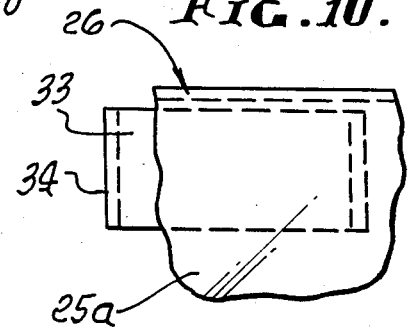
FIG. 10 is a front elevation taken in section on lines 10—10 of FIG. 9.
Figure 3:
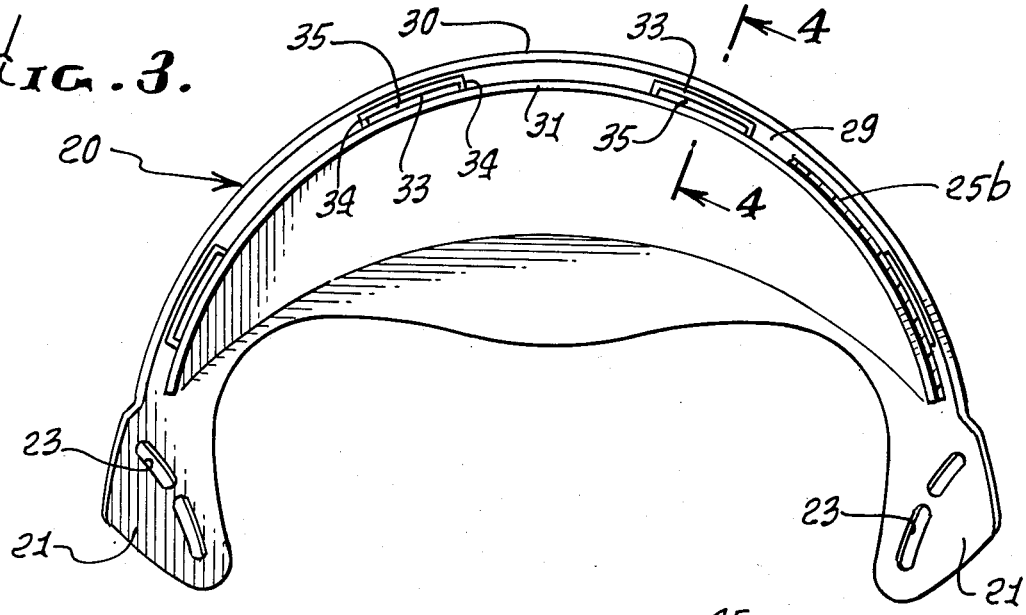
FIG. 3 is a bottom plan view taken in section on lines 3—3 of FIG. 2.

The modified tongues 43 shown in FIG. 7 have wave-shape, and are inserted to interfere slightly with end walls 34, so that curved overhang 43*b* engages the upper edges of walls 34 to support the shield.

Figure 6:
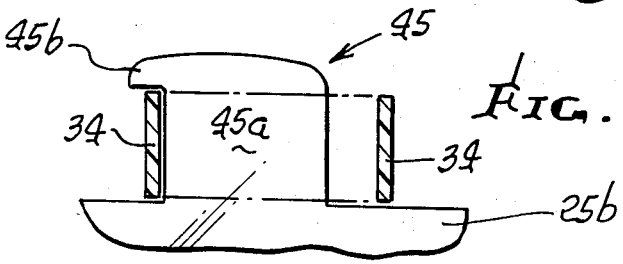

In FIGS. 6 and 11*b* the tongues 45 also have inverted J-shape, as shown. They may be formed so that the side faces of upright portions 45*a* have slight frictional interference fit with panels 31 and 33 upon insertion; and the shield may, after full insertion, be shifted endwise to bring overhanging portions 45*b* of the tongues over the end walls 34, for positively supporting the shield. The frictional interfit of the sides of the tongues with panels 31 and 33 then tends to hold the tongues in FIG. 6 position. Removal is accomplished by reversing the insertion steps.

It will be noted that the visor grooving allows reception of either or both bead types, and multiple tongue type shields, the connections being at the interior of the visor, for safety. This contrasts with prior external connections such as snaps which were subject to inadvertent disconnection as by wearer's arm movement, or wind force. Note also shield end wings 50 that slidably interfit the helmet inner walls in various tilt positions of the shield.

I claim:

1. In combination with a helmet visor projecting generally forwardly, (a) a transparent shield to be supported by the visor so as to extend downwardly from the visor in the helmet wearer's field of view, (b) the visor and shield having thereon tongue and groove interconnection means that retain the shield to the visor along a curved path with said means extending along said path, (c) the interconnection means on the shield located at an upper edge defined by the shield, (d) said interconnection means defined by the shield projecting as a J-shaped deflectible tongue means at the upper edge of the shield, the visor having groove means along said curved path to freely accept said tongue means, the visor having a shoulder extending beneath the tongue means to block downward withdrawal of the tongue means from the groove means, the visor groove means located proximate a forward periphery of the visor and opening downwardly, the groove means located along said curved path which is C-shaped and forwardly convex, and the visor extending over and concealing said groove menas which opens upwardly.

2. The combination of claim 1 wherein said interconnection means consists of plastic material.

3. The combination of claim 1 wherein said tongue means comprises a series of tongues spaced apart on the shield along said path and projecting upwardly for retention in corresponding grooves defined by the visor.

4. The combination of claim 3 wherein tongues have upper portions that project laterally so as to engage visor structure proximate upper extents of the grooves to support the shield, vertically.

5. The combination of any one of claims 3 and 4 wherein said groove means comprises a series of grooves spaced apart along said path to receive upward insertion of said tongues, there being visor panel structure defining said grooves and having edges to engage and support said tongues when fully upwardly inserted in the grooves.

6. The combination of claim 1 wherein said groove means includes:

(i) a single primary groove elongated along said curved path to receive endwise progressive feeding of a primary shield bead advance endwise, and (ii) a series of secondary grooves spaced apart along said curved path to receive upward reception of a series of tongues on a secondary shield, reception and support of either the primary or secondary shield thereby being provided for.

7. The combination of claim 6 wherein the visor has multiple panels spaced apart along said path in direction generally normal thereto to define edges for supporting one or the other of said primary and secondary shields.

8. The combination of claim 1 wherein the shield is resiliently flexible, tending toward unflexing to lie in a flat plane when detached from the visor.

9. The combination of claim 1 including said helmet, and wherein the visor has adjustable attachment ot the helment to be movable between selected positions, relative to the helmet, and wherein the shield is selectively tilted in said positions.

10. The combination of claim 9 wherein the shield has wings that rearwardly interfit the helmet, in said positions.

* * * * *